US007455943B2

(12) United States Patent
Patel et al.

(10) Patent No.: US 7,455,943 B2
(45) Date of Patent: Nov. 25, 2008

(54) HIGH GLOSS EMULSION AGGREGATION TONER INCORPORATING ALUMINIZED SILICA AS A COAGULATING AGENT

(75) Inventors: Raj D. Patel, Oakville (CA); Daryl W. Vanbesien, Burlington (CA); David J. Sanders, Oakville (CA); Allan K. Chen, Oakville (CA)

(73) Assignee: Xerox Corporation, Norwalk, CT (US)

( * ) Notice: Subject to any disclaimer, the term of this patent is extended or adjusted under 35 U.S.C. 154(b) by 332 days.

(21) Appl. No.: 11/250,568

(22) Filed: Oct. 17, 2005

(65) Prior Publication Data

US 2007/0087281 A1 Apr. 19, 2007

(51) Int. Cl.
*G03G 9/087* (2006.01)

(52) U.S. Cl. ..... 430/108.6; 430/108.7; 430/109.3; 430/110.2; 430/137.14

(58) Field of Classification Search ..... 430/109.3, 430/108.6, 108.7, 110.2, 137.14
See application file for complete search history.

(56) References Cited

U.S. PATENT DOCUMENTS

| | | | |
|---|---|---|---|
| 3,847,604 | A | 11/1974 | Hagenbach et al. |
| 4,338,390 | A | 7/1982 | Lu |
| 4,935,326 | A | 6/1990 | Creatura et al. |
| 4,937,166 | A | 6/1990 | Creatura et al. |
| 5,236,629 | A | 8/1993 | Mahabadi et al. |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,330,874 | A | 7/1994 | Mahabadi et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,462,828 | A | 10/1995 | Moffat et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,853,944 | A | 12/1998 | Foucher et al. |
| 5,869,215 | A | 2/1999 | Ong et al. |
| 6,120,967 | A | 9/2000 | Hopper et al. |
| 6,326,117 | B1 | 12/2001 | Ishihara |
| 6,416,920 | B1 | 7/2002 | Hopper et al. |
| 6,576,389 | B2 | 6/2003 | Vanbesien et al. |
| 6,942,954 | B2 * | 9/2005 | Patel et al. ..... 430/137.1 |
| 2004/0058266 | A1 * | 3/2004 | Matsumura et al. ..... 430/110.2 |
| 2004/0072089 | A1 * | 4/2004 | Kishimoto et al. ..... 430/110.2 |
| 2004/0265727 | A1 | 12/2004 | Vanbesien et al. |

OTHER PUBLICATIONS

Diamond, Arthur S & David Weiss (eds.) Handbook of Imaging Materials, 2nd ed.. New York: Marcel-Dekker, Inc. (Nov. 2001) pp. 176-182, 184, 187, 188.*
European Search Report mailed Feb. 16, 2007.

* cited by examiner

*Primary Examiner*—Christopher RoDee
(74) *Attorney, Agent, or Firm*—Oliff & Berridge, PLC

(57) ABSTRACT

The toner includes emulsion aggregation toner particles of a binder including a non-crosslinked styrene acrylate polymer, at least one colorant, at least one wax, and aluminized silica, wherein an amount of aluminum metal in the toner particles is from about 50 ppm to about 600 ppm. Such toner is able to provide a high level of gloss while maintaining a low minimum fixing temperature. The aluminized silica acts as a coagulant during the emulsion aggregation formation process of the toner.

17 Claims, No Drawings

HIGH GLOSS EMULSION AGGREGATION TONER INCORPORATING ALUMINIZED SILICA AS A COAGULATING AGENT

BACKGROUND

Described herein are high gloss toners, and developers containing the toners, for use in forming and developing images of good quality and high gloss, the toner including therein an aluminized silica used as a coagulant during the emulsion aggregation step of forming the toner with a low final metal (aluminum) concentration in the toner.

Emulsion aggregation toners are excellent toners to use in forming print and/or xerographic images in that the toners can be made to have uniform sizes and in that the toners are environmentally friendly. U.S. patents describing emulsion aggregation toners include, for example, U.S. Pat. Nos. 5,370,963, 5,418,108, 5,290,654, 5,278,020, 5,308,734, 5,344,738, 5,403,693, 5,364,729, 5,346,797, 5,348,832, 5,405,728, 5,366,841, 5,496,676, 5,527,658, 5,585,215, 5,650,255, 5,650,256, 5,501,935, 5,723,253, 5,744,520, 5,763,133, 5,766,818, 5,747,215, 5,827,633, 5,853,944, 5,804,349, 5,840,462, and 5,869,215, each incorporated herein by reference in its entirety.

One main type of emulsion aggregation toner includes emulsion aggregation toners that are acrylate based, for example, styrene acrylate toner particles. See, for example, U.S. Pat. No. 6,120,967, incorporated herein by reference in its entirety, as one example.

Emulsion aggregation techniques typically involve the formation of an emulsion latex of the resin particles, which particles have a small size of from, for example, about 5 to about 500 nanometers in diameter, by heating the resin, optionally with solvent if needed, in water, or by making a latex in water using emulsion polymerization. A colorant dispersion, for example of a pigment dispersed in water, optionally also with additional resin, is separately formed. The colorant dispersion is added to the emulsion latex mixture, and an aggregating agent or complexing agent is then added to form aggregated toner particles. The aggregated toner particles are optionally heated to enable coalescence/fusing, thereby achieving aggregated, fused toner particles.

U.S. Pat. No. 5,462,828 describes a toner composition that includes a styrene/n-butyl acrylate copolymer resin having a number average molecular weight of less than about 5,000, a weight average molecular weight of from about 10,000 to about 40,000 and a molecular weight distribution of greater than 6 that provides excellent gloss and high fix properties at a low fusing temperature.

U.S. Pat. No. 6,416,920, incorporated herein by reference in its entirety, describes a process for the preparation of toner by, for example, mixing a colorant, a latex, optionally a wax and a water solubilized silica with an alumina coating or an aluminized silica as a coagulant. See the Abstract. However, this patent does not describe or suggest the advantages associated with the use of an aluminized silica coagulant in the specific emulsion aggregation toner described herein. This patent also does not describe the desirability of limiting the metal (aluminum) concentration in the final toner, for example by subjecting the toner to an extraction step after formation of the toner.

What is still desired is a styrene acrylate emulsion aggregation toner that can achieve excellent gloss and print quality.

SUMMARY

In embodiments, described is a toner comprising emulsion aggregation toner particles comprising a binder including a non-crosslinked styrene acrylate polymer, at least one colorant, at least one wax, and aluminized silica, wherein the final amount of aluminum in the toner particles is from about 50 ppm to about 600 ppm.

In further embodiments, described is a toner comprising emulsion aggregation toner particles comprising a core and a shell, wherein the core is comprised of a binder including a non-crosslinked styrene acrylate polymer, at least one colorant, at least one wax, and aluminized silica, and wherein the shell is comprised of a second non-crosslinked styrene acrylate polymer having a glass transition temperature higher than a glass transition temperature of the core non-crosslinked styrene acrylate polymer.

In still further embodiments, described is a method of making a toner comprising emulsion aggregation toner particles comprising a binder including a non-crosslinked styrene acrylate polymer, at least one colorant, at least one wax, and aluminized silica, wherein the final amount of aluminum in the toner particles is from about 50 ppm to about 600 ppm, the method comprising:

obtaining a latex of the non-crosslinked styrene acrylate polymer, an aqueous dispersion of the at least one colorant, an aqueous dispersion of the at least one wax, and an aqueous dispersion of the aluminized silica, forming a mixture of the latex of the non-crosslinked styrene acrylate polymer, the aqueous dispersion of the at least one colorant, and the aqueous dispersion of the at least one wax, adding some or all of the aqueous dispersion of the aluminized silica to the mixture, stirring the mixture, and heating the mixture to a temperature below a glass transition temperature of the non-crosslinked styrene acrylate polymer, any remaining portion of the aqueous dispersion of the aluminized silica being added to the mixture during the heating, maintaining the temperature of heating to form aggregated toner particles, adding a solution of a sequestering agent, followed by stopping further aggregation and raising the temperature to at least about 80° C. to coalesce the aggregated particles, and subsequently cooling, optionally washing, and recovering the emulsion aggregation toner particles, wherein the sequestering agent is added in an amount to extract aluminum ions from the solution such that the final aluminum content in the toner is from abut 50 ppm to about 600 ppm.

DETAILED DESCRIPTION OF EMBODIMENTS

The toner particles described herein are comprised of binder, at least one colorant, at least one wax, and aluminized silica, with a final aluminum content in the toner of less than 600 ppm, for example from about 50 ppm to about 600 ppm, from about 50 ppm to about 500 ppm, or from about 50 ppm to about 400 ppm. Each of these components of the toner particles is further described below.

In embodiments, the binder is comprised of a non-crosslinked polymer. The polymer(s) of the binder may be an acrylate-containing polymer, for example a styrene acrylate polymer. Illustrative examples of specific polymers for the binder include, for example, poly(styrene-alkyl acrylate), poly(styrene-alkyl methacrylate), poly(styrene-alkyl acrylate-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(alkyl acrylate-acrylonitrile-acrylic acid), poly(methyl methacrylate-butadiene), poly(ethyl methacrylate-butadiene), poly (propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene), poly(styrene-propyl acrylate), poly(styrene-butyl acrylate), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and other similar polymers. The alkyl group in the aforementioned polymers may be any alkyl group, and in particular may be a $C_1$-$C_{12}$ alkyl group, for example including methyl, ethyl, propyl and butyl. As the aryl group, any aryl group may be used.

In embodiments, the non-crosslinked polymer is styrene-alkyl acrylate, more particularly a styrene-butyl acrylate polymer such as a styrene-butyl acrylate-β-carboxyethyl acrylate polymer.

The monomers used in making the polymer binder are not limited, and the monomers utilized may include any one or more of, for example, styrene, acrylates such as methacrylates, butylacrylates, β-carboxyethyl acrylate (β-CEA), etc., butadiene, isoprene, acrylic acid, methacrylic acid, itaconic acid, acrylonitrile, benzenes such as divinylbenzene, etc., and the like. In an embodiment, the monomers for making the polymer may include therein a carboxylic acid monomer, for example selected among acrylic acid, methacrylic acid, itaconic acid, β-carboxyethyl acrylate, fumaric acid, maleic acid, and cinnamic acid. When present, the carboxylic acid may be included in an amount of from about 0.1% to about 10% by weight of the monomer components.

Known chain transfer agents can be utilized to control the molecular weight properties of the polymer. Examples of chain transfer agents include dodecanethiol, dodecylmercaptan, octanethiol, carbon tetrabromide, carbon tetrachloride, and the like, present in various suitable amounts, for example from about 0.1 to about 10 percent by weight of the total monomers such as from about 0.1 to about 8 percent by weight or from about 0.2 to about 5 percent by weight of total monomers.

In embodiments, the toner particles may have a core-shell structure. In such embodiments, the core is comprised of the non-crosslinked polymer binder discussed above, as well as the colorant(s), optional wax(es) and aluminized silica as will be discussed below. Once the core particle is formed and aggregated to a desired size, a thin outer shell is then formed upon the core particle. The shell may be comprised of only a non-crosslinked polymer material having a higher glass transition temperature (Tg) than the Tg of the non-crosslinked polymer material of the core binder, although other components may be included in the shell if desired. Higher Tg means that the Tg of the binder is higher in value by any amount. For example, the Tg of the shell non-crosslinked polymer is higher than the Tg of the core non-crosslinked polymer by at least about 2° C. or by at least about 4° C., such as from about 2° C. to about 15° C., for example by about 4° C. to about 10° C. or from about 3° C. to about 6° C. It is desirable for the shell to have a higher Tg than the Tg of the core non-crosslinked polymer in order to prevent blocking, that is, clumping of the toner, such as may occur in higher temperature (such as 28° C. or more) and/or humidity (such as 75% or more) environments without the higher Tg shell. The shell material may be comprised of the same styrene acrylate, for example styrene-butyl acrylate such as styrene-butyl acrylate-β-carboxyethyl acrylate, as the core binder, the difference being in the Tg of the shell material as compared to the Tg of the core material.

To achieve the non-crosslinked styrene acrylate polymer having a higher Tg than the Tg of the core binder non-crosslinked styrene acrylate polymer, the monomer system may be made to include a higher amount of styrene to acrylate and/or include lesser amounts of chain transfer agents. For example, a monomer system of about 70% to about 80% styrene and about 20% to about 30% of an acrylate such as butyl acrylate can be made to have a Tg of about 50° C., while a monomer system of about 80% to about 90% styrene and about 10% to about 20% of an acrylate such as butyl acrylate can be made to have a Tg of about 60° C. The shell non-crosslinked polymer may have a Tg of at least about 50° C., for example from about 50° C. to about 70° C. such as from about 55° C. to about 65° C. The core non-crosslinked polymer may have a Tg of about 45° C. to about 65° C., such as from about 49° C. to about 58° C. or from about 50° C. to about 55° C. Moreover, the core non-crosslinked polymer may have a weight average molecular weight (Mw) of from about 10,000 to about 100,000 such as from about 10,000 to about 50,000 or from about 25,000 to about 40,000, and the shell non-crosslinked polymer may have a Mw of from about 10,000 to about 150,000 such as from about 15,000 to about 60,000 or from about 30,000 to about 45,000, although such ranges are merely exemplary.

The shell latex, when present, may be added to the core toner particle aggregates in an amount of about 5 to about 40 percent by weight of the total binder materials, for example in an amount of about 5 to about 30 percent by weight or from about 7 to about 25 percent by weight of the total binder materials. The shell or coating on the toner aggregates may be formed to have a thickness of about 0.2 to about 2 μm, such as from about 0.2 to about 1.5 μm or from about 0.5 to about 1 μm.

Because the presence of crosslinked gel particles tends to reduce the gloss achievable by a toner, the monomer systems of the polymers may be free of crosslinking agents such as divinylbenzene. The resulting toner binder materials are thus substantially free of crosslinked polymer.

The total amount of binder, including core and shell if present, may comprise an amount of from about 60 to about 95% by weight of the toner particles (that is, toner particles exclusive of external additives) on a solids basis, or example from about 70 to about 90% by weight of the toner.

In embodiments, the polymer for the core and shell binders may each be formed into a latex for use in the subsequent emulsion aggregation toner particle formation process. Such may be done by mixing the monomer components, including any additive agents as discussed above, in an aqueous phase, optionally in the presence of one or more surfactants, and then polymerizing the monomers, for example with the use of an initiator, to form small sized seed particles. A latex having an aqueous phase with small sized polymer particles therein, for example on the order of about 5 nm to about 500 nm, such as from about 50 nm to about 300 nm, is derived. Any suitable method for forming the latex from the monomers may be used.

Various suitable colorants can be employed, including suitable colored pigments, dyes, and mixtures thereof. Suitable examples include, for example, carbon black such as REGAL 330 carbon black, acetylene black, lamp black, aniline black, Chrome Yellow, Zinc Yellow, SICOFAST Yellow, SUNBRITE Yellow, LUNA Yellow, NOVAPERM Yellow, Chrome Orange, BAYPLAST Orange, Cadmium Red, LITHOL Scarlet, HOSTAPERM Red, FANAL PINK, HOSTAPERM Pink, LUPRETON Pink, LITHOL Red, RHODAMINE Lake B, Brilliant Carmine, HELIOGEN Blue, HOSTAPERM Blue, NEOPAN Blue, PV Fast Blue, CINQUASSI Green, HOSTAPERM Green, titanium dioxide, cobalt, nickel, iron powder, SICOPUR 4068 FF, and iron oxides such as MAPICO Black (Columbia) NP608 and NP604 (Northern Pigment), BAYFERROX 8610 (Bayer), M08699 (Mobay), TMB-100 (Magnox), mixtures thereof and the like.

The colorant, for example carbon black, cyan, magenta and/or yellow colorant, is incorporated in an amount sufficient to impart the desired color to the toner. In general, pigment or dye is employed in an amount ranging from about 2% to about 35% by weight of the toner particles on a solids basis, such as from about 2% to about 25% by weight or from about 2% to about 10% by weight of the toner particles on a solids basis. Of course, as the colorants for each color are different, the amount of colorant present in each type of color toner may be different.

To incorporate the colorant(s) into the toner, the colorant may be in the form of an aqueous emulsion or dispersion of colorant in water, optionally with use of a surfactant such as an anionic or non-ionic surfactant, where the colorant is in embodiments a pigment with a particle size of from about 50 nm to about 3000 nm such as from about 100 nm to about 2000 nm or from about 50 nm to about 1000 nm.

Examples of anionic surfactants that can be selected for the processes illustrated herein include, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN RK™, NEOGEN SC™ from Kao and the like. An effective concentration of the anionic surfactant generally employed is, for example, from about 0.01 to about 10 percent by weight, such as from about 0.1 to about 5 percent by weight, of the dispersion.

Examples of nonionic surfactants that can be selected for the processes illustrated herein include, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy)ethanol, available from Rhodia as IGEPAL CA-210®, IGEPAL CA-520®, IGEPAL CA-720®, IGEPAL CO-890®, IGEPAL CO-720®, IGEPAL CO-290®, IGEPAL CA-210®, ANTAROX 890® and ANTAROX 897®. A suitable concentration of the nonionic surfactant is, for example, from about 0.01 to about 10 percent by weight, and more specifically, from about 0.1 to about 5 percent by weight, of the dispersion.

In addition to the polymer binder and the colorant, the toners may also contain a wax dispersion. The wax may be added to the toner formulation in order to aid toner offset resistance, for example toner release from the fuser roll, particularly in low oil or oil-less fuser designs.

Waxes that may be selected include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K. The commercially available polyethylenes selected possess, it is believed, a molecular weight $M_W$ of from about 500 to about 15,000, while the commercially available polypropylenes are believed to have a molecular weight of from about 3,000 to about 7,000. Additional waxes that may be used include, for example, plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsh wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures of waxes may also be used.

For emulsion aggregation (EA) toners, for example styrene-acrylate EA toners, linear polyethylene waxes such as the POLYWAX® line of waxes available from Baker Petrolite are useful, for example POLYWAX 725 or POLYWAX 850. The wax may have a melting point of about 70° C. to about 100° C. such as from about 85° C. to about 95° C.

To incorporate the wax into the toner, the wax may be in the form of an aqueous emulsion or dispersion of solid wax in water, where the solid wax particle size is usually in the range of from about 100 to about 500 nm.

The toners may contain from, for example, about 3.5% to about 15% by weight of the toner, on a solids basis, of the wax, such as from about 5% to about 12% by weight of wax.

In addition, the toners contain an amount of aluminized silica utilized as a coagulant in the emulsion aggregation toner particle formation process. Inclusion of the silica is advantageous as such may act as a flow agent for the toner, and thereby reduce the amount of silica to add as an external additive to an external surface of the toner particle, which results in a cost savings. Conventional coagulants used in the emulsion aggregation art have included multivalent ion coagulants such as polyaluminum chloride (PAC) and/or polyaluminum sulfosilicate (PASS). It has been found, however, that use of aluminized silica as a coagulant is equally as effective, and has the further advantages discussed above.

Aluminized silica as used herein refers to, for example, an aluminum treated silica, that is, a silica, and in particular a colloidal silica, in which at least a majority of the silicon atoms on the surface of the silica have been replaced by aluminum. Majority refers to, for example, an amount greater than 50%, for example from about 51% to about 100% such as from about 51% to about 95%. The resulting aluminized silica may be characterized as having an alumina coating upon the silica surface. Aluminized silica is available commercially from various manufacturers, including DuPont, Nalco and EKA Chemicals. Aluminum treated colloidal silica differs from pure silica as the alumina rich surface imparts a positive charge to the colloidal material in aqueous deionized or acidic environments. The polarity difference imparts different and advantageous colloidal behavior to the small particles.

The aluminized silica is present in an amount of from, for example, about 0.1 pph to about 50 pph by weight of the toner, such as from about 0.1 to about 20 pph or from about 1 pph to about 5 pph by weight of the toner.

Accordingly, the toner may be comprised of from about 70% to about 95% by weight of the non-crosslinked styrene acrylate polymer, including both core and shell, if present, from about 5% to about 15% by weight of the wax, from about 2% to about 10% by weight of the colorant, and from about 0.1 to about 50 pph of the aluminized silica.

The toner herein may exhibit a high gloss, which in embodiments refers to a gloss of at least about 30 GGU (Gardiner Gloss Units), such as about 30 GGU to about 70 GGU or from about 40 GGU to about 70 GGU, on plain paper (such as Xerox 90 gsm COLOR XPRESSIONS+paper) and of at least about 40 GGU, such as about 40 GGU to about 80 GGU or from about 50 GGU to about 80 GGU, on coated papers (such as Xerox 120 gsm Digital Coated Gloss paper).

For high gloss, the presence of aluminum metal and/or metal ions in the end toner particle is not be desirable because the aluminum hinders the gloss that can be obtained (the higher the aluminum content, the lower the gloss of the toner, for example due to the crosslinking), and thus the aluminum should be substantially extracted from the formed toner particles. Although such extraction may be done by any suitable method, the method in embodiments comprises adding a sequestering agent to the aggregated toner particles to extract aluminum ions therefrom in a controlled manner, i.e., in a manner such that the end content of aluminum present in the toner can be controlled. As the sequestering agent, mention may be made of ethylenediaminetetraacetic acid (EDTA) (commercially available as VERSENE 100), sodium silicate solution and the like.

The sequestering agent may be added in an amount effective to extract aluminum ions from the solution such that the final aluminum content in the toner is less than about 600 ppm, for example from about 50 ppm to about 600 ppm such as from about 50 ppm to about 500 ppm or from about 50 ppm to about 400 ppm. The amount of sequestering agent added may be from about 0.01% to about 10% by weight of the solution, for example from about 0.01% to about 5% or from about 0.5% to about 5% by weight of the solution. In embodiments, the sequestering agent is substantially not present in the end toner, and thus is added in an amount substantially equal to the amount needed to achieve the aforementioned amount of aluminum in the end toner, and substantially not in excess of such amount so that excess sequestering agent is not retained in the toner.

The sequestering agent may be added near the end of the aggregation step in the emulsion aggregation toner particle formation process, although such extraction may also be done at any time subsequent to aggregation and prior to any coalescence step.

The toner may also include additional known positive or negative charge additives in effective suitable amounts of, for example, from about 0.1 to about 5 weight percent of the toner, such as quaternary ammonium compounds inclusive of alkyl pyridinium halides, bisulfates, organic sulfate and sulfonate compositions such as disclosed in U.S. Pat. No. 4,338,390, cetyl pyridinium tetrafluoroborates, distearyl dimethyl ammonium methyl sulfate, aluminum salts or complexes, and the like.

In preparing the toner by the emulsion aggregation procedure, one or more surfactants may be used in the process. Suitable surfactants include anionic, cationic and nonionic surfactants. The anionic and nonionic surfactants may be any of those described above.

Examples of cationic surfactants, which are usually positively charged, selected for the toners and processes herein include, for example, alkylbenzyl dimethyl ammonium chloride dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof. A suitable amount of cationic surfactant can be selected, such as from about 0.2 to about 5 percent by weight of the solution.

Any suitable emulsion aggregation procedure may be used in forming the emulsion aggregation toner particles. These procedures typically include the basic process steps of at least aggregating an aqueous latex emulsion containing the binder polymer(s), colorant(s), wax(es), optionally one or more surfactants, coagulant and any additional optional additives to form aggregates, optionally forming the shell on the aggregated core particles by addition of a latex of the shell material, optionally extracting metal (aluminum) from the particles, subsequently optionally coalescing or fusing the aggregates, and then recovering, optionally washing and optionally drying the obtained emulsion aggregation toner particles.

An example emulsion/aggregation/coalescing process includes forming a non-crosslinked polymer latex, for example comprised of a styrene acrylate polymer, forming a wax dispersion and forming a colorant dispersion, mixing the non-crosslinked polymer latex, crosslinked polymer latex, wax dispersion and colorant dispersion, and adding aluminized silica as a coagulant to the mixture. The mixture may be stirred using a homogenizer until homogenized and then transferred to a reactor where the homogenized mixture is heated to a temperature below the Tg of the binder polymers, for example, to at least about 40° C., and held at such temperature for a period of time to permit aggregation of toner particles to a desired size. Additional aluminized silica may be added to the mixture during heating/aggregation, as desired or required. Additional binder latex, for example the higher Tg non-crosslinked polymer latex, may then be added to form the shell upon the aggregated core particles. Once the desired size of aggregated toner particles is achieved, (1) a solution of sequestering agent may be added to extract the aluminum metal from the aluminized silica and toner, and (2) further aggregation may be stopped by any desired means, for example by raising the pH of the mixture to inhibit further toner aggregation, for example raising the pH from about 2 to about 3 to about 7 to about 8 or from about 2 to about 2.8 to about 7 to about 7.5 by the addition of a suitable pH agent of, for example, sodium silicate dissolved in sodium hydroxide to provide for the stabilization of the aggregated particles and to prevent/minimize the toners size growth and loss of GSD during further heating, for example, raising the temperature about 10° C. to about 50° C. above the resin Tg. The toner particles thus are further heated to a temperature of, for example, at least about 90° C., and the pH lowered, for example to below about 5 or about 4.5, in order to enable the particles to coalesce and spherodize. The heater is then turned off and the reactor mixture allowed to cool to room temperature, at which point the aggregated and coalesced toner particles are recovered and optionally washed and dried.

In preparing the non-crosslinked polymer latex for the core, the polymer may be comprised of at least styrene, butyl acrylate, and β-carboxyethyl acrylate (β-CEA). In embodiments, the composition of the monomers is about 70% to about 80% styrene, about 20% to about 30% butyl acrylate and about 0.5 to about 3.0 pph of β-CEA, although the monomers as stated are not limited to the particular range or type as has been discussed above. The latex polymer is formed by an emulsion polymerization, in the presence of an initiator, a chain transfer agent and surfactant. The amount of initiator, such as sodium, potassium or ammonium persulfate, may be in the range of about 0.5 to about 5% by weight of the monomers. The amount of chain transfer agent utilized may be in the range of about 0.5 to about 5% by weight of styrene and butyl acrylate. The surfactant utilized may be an anionic surfactant, although not limited, and is in the range of 0.7 to about 5% by weight of the aqueous phase. The emulsion polymerization in embodiments may be conducted under a starve fed polymerized emulsion to provide latex resin particles which are in the size range of, for example, from about 100 nm to about 300 nm.

In preparing the high Tg non-crosslinked polymer latex of the shell, the polymer may be comprised of at least styrene, butyl acrylate, and β-carboxyethyl acrylate (β-CEA). In embodiments, the composition of the monomers is about 80% to about 90% styrene, about 10% to about 20% butyl acrylate and about 0.5 to about 3.0 pph of β-CEA, although the monomers as stated are not limited to the particular range or type as has been discussed above. The latex polymer is formed by an emulsion polymerization, in the presence of an initiator, a chain transfer agent and surfactant. The amount of initiator, such as sodium, potassium or ammonium persulfate, may be in the range of about 0.5 to about 5% by weight of the monomers. The amount of chain transfer agent utilized may be in the range of about 0.5 to about 3% by weight of styrene and butyl acrylate. The surfactant utilized may be an anionic surfactant, although not limited, and is in the range of 0.7 to about 5% by weight of the aqueous phase. The emulsion polymerization in embodiments may be conducted under a starve fed polymerized emulsion to provide latex resin particles which are in the size range of about 100 to about 300 nm.

In preparing the wax dispersion, the wax may be a polyethylene or a polypropylene wax, carnauba wax, paraffin wax or a functionalized wax, for example with a melting point from about 70° C. to about 110° C., for example from about 85° C. to about 105° C. The wax may have a particle diameter in the range of about 100 to about 500 nm. The surfactant utilized to disperse the wax may be an anionic surfactant, although not limited. The amount of wax added may be in the range of about 5 to about 15% by weight by weight of the monomers.

In preparing the colorant dispersion, a dispersion of the colorant, for example as a pigment, may be prepared. The colorant dispersion may have a pigment particle in the size range of about 50 to about 300 nm. The surfactant utilized to disperse the colorant may be an anionic and/or nonionic surfactant, although not limited. Suitable equipment, for example an ultimizer, media mill, etc., may be used to provide the pigment dispersion.

The composite toner particles may be formed by mixing the non-crosslinked polymer latex of the core with the wax and the colorant dispersions. A coagulant of an aluminized silica is added to the mixture while being blended, for example using a polytron or any other suitable equipment. The resulting mixture, for example having a pH of about 2 to about 3, is then aggregated by heating to a temperature below the resin Tg of the non-crosslinked polymer to provide toner size aggregates. The heating may be to a temperature of about 40° C. to about 65° C. Once a desired initial size of aggregates is obtained, the higher Tg non-crosslinked polymer latex may then be added to the formed aggregates, this later addition of latex providing the shell over the pre-formed aggregates. Aggregation continues until the shell is of a desired thickness and the aggregates have formed a desired overall size. The pH of the mixture is then changed, for example by the addition of a sodium hydroxide solution, to about 4. A solution of the sequestering agent such as EDTA or sodium silicate may then be added to extract the aluminum metal ions and at least partially remove them from the toner. The resulting pH may be, or adjusted to be, about 6 to about 7. At this pH, the carboxylic acid becomes ionized to provide additional negative charge on the aggregates, thereby providing stability and preventing the particles from further growth or an increase in the GSD when heated above the Tg of the latex resin. The temperature is thereafter raised to at least about 80° C., for example to at least about 90° C., to coalesce or fuse the aggregates. The pH of the mixture may then be reduced to about 4 to about 5, for example with acid addition such as nitric acid. The particles may be measured for shape factor or circularity using a Sysmex FPIA 2100 analyzer, and coalescence permitted to continue until a desired shape is achieved. The pH may the be adjusted to about 7 and the heating continued, for example for about 1 to about 5 hours, such as about 3 hours. The particles are then allowed to cool to room temperature and optionally washed. In embodiments, the washing includes a first wash conducted at a pH of about 10 and at a temperature of about 63° C., followed by a deionized water wash at room temperature, followed by a wash at a pH of about 4 and at a temperature of about 40° C., followed by a final deionized water wash. The toner is then dried and recovered. The sequestering agent is added in order to extract the aluminum metal ions present in the solution that are present as a result of the use of the aluminized silica, and achieve the end aluminum metal/ion content in the toner.

In embodiments, the toner particles are made to have an average particle size of from about 1 to about 15 micrometers, such as from about 2 to about 10 micrometers or from about 2 to about 7 micrometers, with a shape factor of from about 120 to about 140 and an average circularity of about 0.93 to about 0.98. The particle size may be determined using any suitable device, for example a conventional Coulter counter. The shape factor and circularity may be determined using a Malvern Sysmex Flow Particle Image Analyzer FPIA-2100. The circularity is a measure of the particles closeness to a perfect sphere. A circularity of 1.0 identifies a particle having the shape of a perfect circular sphere.

The toner particles cohesivity is associated to some degree with the surface morphology of the particles. The rounder/smoother the surface of the particles, the lower the cohesion and the greater the flow. As the surface becomes less round/rougher, the flow worsens and the cohesion increases.

The toner particles also may have a size distribution such that the volume geometric standard deviation (GSDv) for (D84/D50) is in the range of from about 1.15 to about 1.25. The particle diameters at which a cumulative percentage of 50% of the total toner particles are attained are defined as volume D50, and the particle diameters at which a cumulative percentage of 84% are attained are defined as volume D84. These aforementioned volume average particle size distribution indexes GSDv can be expressed by using D50 and D84 in cumulative distribution, wherein the volume average particle size distribution index GSDv is expressed as (volume D84/volume D50). The GSDv value for the toner particles indicates that the toner particles are made to have a very narrow particle size distribution.

The toner particles may be blended with external additives following formation. Any suitable surface additives may be used. The external additives may include, for example, one or more of $SiO_2$, metal oxides such as, for example, $TiO_2$ and aluminum oxide, and a lubricating agent such as, for example, a metal salt of a fatty acid (e.g., zinc stearate (ZnSt), calcium stearate) or long chain alcohols such as UNILIN 700. In general, silica is applied to the toner surface for toner flow, tribo enhancement, admix control, improved development and transfer stability and higher toner blocking temperature. $TiO_2$ is applied for improved relative humidity (RH) stability, tribo control and improved development and transfer stability. Zinc stearate may also be used as an external additive for the toners of the invention, the zinc stearate providing lubricating properties. Zinc stearate provides developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. A commercially available zinc stearate is known as Zinc Stearate L, obtained from Ferro Corporation. The external surface additives can be used with or without a coating.

The toners may contain from, for example, about 0.5 to about 5 weight percent titania (size of from about 10 nm to about 50 nm, for example about 40 nm), about 0.5 to about 5 weight percent silica (size of from about 10 nm to about 50 nm, for example about 40 nm), about 0.5 to about 5 weight percent sol-gel silica and about 0.1 to about 4 weight percent zinc stearate.

The toner particles can optionally be formulated into a developer composition by mixing the toner particles with carrier particles. Illustrative examples of carrier particles that can be selected for mixing with the toner composition include those particles that are capable of triboelectrically obtaining a charge of opposite polarity to that of the toner particles. Accordingly, in one embodiment, the carrier particles may be selected so as to be of a positive polarity in order that the toner particles that are negatively charged will adhere to and surround the carrier particles. Illustrative examples of such carrier particles include granular zircon, granular silicon, glass, steel, nickel, iron ferrites, silicon dioxide, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles can be used with or without a coating, the coating generally being comprised of fluoropolymers, such as polyvinylidene fluoride resins, terpolymers of styrene, methyl methacrylate, and a silane, such as triethoxy silane, tetrafluoroethylenes, other known coatings and the like.

A suitable carrier herein is a steel core, for example of about 50 to about 75 μm in size, coated with about 0.5% to about 5% by weight, for example about 1% by weight, of a conductive polymer mixture comprised of methylacrylate and carbon black using the process described in U.S. Pat. Nos. 5,236,629 and 5,330,874.

The carrier particles can be mixed with the toner particles in various suitable combinations. The concentrations are usually about 1% to about 20% by weight of toner and about 80% to about 99% by weight of carrier. However, one skilled in the art will recognize that different toner and carrier percentages may be used to achieve a developer composition with desired characteristics.

The toners can be used in known electrostatographic imaging methods. Thus for example, the toners or developers can be charged, for example triboelectrically, and applied to an oppositely charged latent image on an imaging member such as a photoreceptor or ionographic receiver. The toner/developer may be supplied from a housing of the imaging device. The resultant toner image can then be transferred, either directly or via an intermediate transport member, to an image receiving substrate such as paper or a transparency sheet. The toner image can then be fused to the image receiving substrate by application of heat and/or pressure, for example with a heated fuser roll.

The toner particles and preparation thereof will now be further described via the following illustrative examples.

EXAMPLE

Preparation of non-crosslinked polymer latex A for core: A latex emulsion comprised of polymer particles generated from the emulsion polymerization of styrene, n-butyl acrylate and β-CEA was prepared as follows. A surfactant solution consisting of 605 grams DOWFAX 2A1 (anionic emulsifier) and 387 kg deionized water was prepared by mixing for 10 minutes in a stainless steel holding tank. The holding tank was then purged with nitrogen for 5 minutes before transferring into the reactor. The reactor was then continuously purged with nitrogen while being stirred at 100 rpm. The reactor was then heated up to 80° C. at a controlled rate. Separately, 6.1 kg of ammonium persulfate initiator was dissolved in 30.2 kg of deionized water. Also separately, the monomer emulsion was prepared by mixing 311.4 kg of styrene, 95.6 kg of butyl acrylate and 12.21 kg of β-CEA, along with 2.88 kg of 1-dodecanethiol, 1.42 kg of decanediol diacrylate (ADOD), 8.04 kg of DOWFAX 2A1 (anionic surfactant), and 193 kg of deionized water to form an emulsion. One percent of the above emulsion is then slowly fed into the reactor containing the aqueous surfactant phase at 80° C. to form the seed particles while being purged with nitrogen. The initiator solution is then slowly charged into the reactor and after 10 minutes, the rest of the emulsion is continuously fed in a using metering pump at a rate of 0.5%/min. Once all the monomer emulsion is charged into the main reactor, the temperature is held at 80° C. for an additional 2 hours to complete the reaction. Full cooling is then applied and the reactor temperature is reduced to 35° C. The product is collected into a holding tank. After drying the latex, the molecular properties were Mw=36, 200, Mn=10,900 and onset Tg=51° C. The mean particle size was 254 nm.

Preparation of aluminized silica solution C: 20 g of 40 nm aluminized silica (available from Eckart) having a solids loading of 44.6% was added to 170 g of deionized water. The resulting solution (Solution C) had a concentration of 0.047 g/ml.

Toner particle preparation: 340 g of non-crosslinked latex (Latex A) having a solids loading of 40% by weight and 53 g of POLYWAX 725 wax dispersion having a solids loading of 30% are added to 630 g of deionized water, in a vessel and stirred using an IKA Ultra Turrax® T50 homogenizer operating at 4,000 rpm. Thereafter, 20 g of cyan pigment dispersion SUN PIGMENT BHD 6000 (PB 15:3) having a solids loading of 50.9% by weight are added to the reactor, followed by drop-wise addition of 60 g of the above solution C. As the solution C is added drop-wise, the homogenizer speed is increased to 5,200 rpm and homogenized for an additional 5 minutes. The mixture is then heated at 1° C. per minute to 50° C., during which time an additional 60 g of solution C was added and the contents allowed to aggregate at 50° C. After about 1.5 to 2 hours, the particle size obtained was 5.0 μm. During the heat up period, the stirrer is run at about 250 rpm and 10 minutes after the set temperature is reached, the stirrer speed is reduced to about 220 rpm. 134.6 g of latex resin A is added to the reactor mixture and allowed to aggregate for an additional period of about 30 minutes at 51° C., resulting in a volume average particle diameter of about 5.7 microns. 5 g of EDTA (VERESEN 100) having a solids loading of 39% was added to the reactor, followed by adding sodium hydroxide until the pH of the mixture was 4.5. The pH of the reactor mixture is then further adjusted to pH 7.0 with 1.0 M sodium hydroxide solution. Thereafter, the reactor mixture is heated at 1° C. per minute to a temperature of 95° C. The pH of the mixture was then reduced to 5.0 with 4% nitric acid. Following this, the reactor mixture is gently stirred at 95° C. for 5 hours to enable the particles to coalesce and spherodize. The reactor heater is then turned off and the reactor mixture is allowed to cool to room temperature at a rate of 1° C. per minute. The toner of this mixture comprises about 88% by weight of styrene/acrylate polymer resin A, about 4.7% by weight of PB 15:3 pigment, and about 7.3% by weight percent POLYWAX 725 wax, and has a volume average particle diameter of about 5.7 microns and a GSDv of about 1.19.

COMPARATIVE EXAMPLES

A first comparative toner was prepared with 10% silica and polyaluminum chloride as the coagulant. 431 g of deionized water with 181.3 g styrene/butyl acrylate latex (40% solids), 31.8 g of PB 15:3 cyan pigment (25.76% solids) and 39.8 g of POLYWAX 725 wax (30.92% solids) were charged in a 2-liter stainless steel Buchi reactor. The mixture was mixed and homogenized at 6,000 rpm by a Turrax homogenizer probe for 10 minutes. During the high shear mixing step, a premixed silica gel mixture containing 21.4 g of 8 nm OL silica (21.07% solids), 49.7 g of 40 nm OS silica (21.13% solids), 3 g of polyaluminum chloride and 27 g of 0.02M hydrochloric acid was added. Then the reactor was heated to 51° C. Particle growth was monitored during heating. Toner particle size was checked from time to time. When the reactor temperature reached 51° C., the toner particles started growing slowly under a constant temperature. In approximately 3 hours time, the particle size was around 4.8 microns. At this stage, 103.6 g of shell latex (same as the core) was added to the toner slurry. The toner particle size continued to grow with the addition of shell latex. After the target toner particle size of 5.7 micron was achieved, the pH of the reactor content was changed from about 2.0 to about 7.0 with 4% NaOH solution. Following this, the reactor contents were heated up to about 90° C. to coalesce the aggregates without further increase in particle size. Upon reaching the coalescence temperature, the pH was lowered to about 5.0 with 4% nitric acid and allowed to coalesce for 5 hours at 90° C. The particle size obtained was 5.7 microns with a GSDv of 1.18. The reactor content was cooled down and its content was discharged.

A second comparative example toner was prepared using polyaluminum chloride only with the above Latex A and the same processing conditions.

In fusing results (gloss and crease area), the Example toner exhibited much better gloss and reduced crease area compared to the Comparative Example 2 toner. The Example toner also exhibited the same as or better gloss over the temperature range of 130° C. to 190° C. compared to the Comparative Example 1 toner, and about the same crease area over such temperature range.

| Toner/Properties | Example 1 | Comparative Toner |
|---|---|---|
| Gloss (75 deg) at 160° C. | 62 | 42 |
| Crease (Log CA) 1.5 | 158° C. | 156° C. |

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A toner comprising emulsion aggregation toner particles comprising a binder including a non-crosslinked styrene acrylate polymer, at least one colorant, at least one wax, and aluminized silica, wherein an amount of aluminum metal in the toner particles is from about 50 ppm to about 600 ppm, wherein the toner is comprised of from about 70% to about 95% by weight of the non-crosslinked styrene acrylate polymer, from about 5% to about 15% by weight of the wax, from about 2% to about 10% by weight of the colorant, and from about 0.5 to about 50 pph of the aluminized silica by weight of toner.

2. The toner according to claim 1, wherein the amount of aluminum is achieved by addition of a sequestering agent to the toner.

3. The toner according to claim 1, wherein the non-crosslinked styrene acrylate polymer is a styrene butyl acrylate polymer.

4. The toner according to claim 1, wherein the non-crosslinked styrene acrylate polymer is derived from monomers including styrene, butyl acrylate and β-carboxyethyl acrylate.

5. The toner according to claim 1, wherein the non-crosslinked styrene acrylate polymer has a weight average molecular weight of from about 25,000 to about 40,000 and an onset glass transition temperature of from about 49° C. to about 58° C.

6. The toner according to claim 1, wherein the wax has a melting point of from about 70° C. to about 100° C.

7. The toner according to claim 1, wherein the toner particles make up a core, and further included thereon is a shell layer comprised of a second non-crosslinked styrene acrylate polymer having a glass transition temperature higher than a glass transition temperature of the core non-crosslinked styrene acrylate polymer.

8. The toner according to claim 7, wherein the core non-crosslinked styrene acrylate polymer and the second non-crosslinked styrene acrylate polymer of the shell are derived from a same set of monomers.

9. The toner according to claim 7, wherein the core non-crosslinked styrene acrylate polymer has a glass transition temperature of about 45° C. to about 65° C., the second non-crosslinked styrene acrylate polymer of the shell has a glass transition temperature of about 50° C. to about 70° C., and wherein the glass transition temperature of the second non-crosslinked styrene acrylate polymer of the shell is at least about 4° C. higher than the glass transition temperature of the core non-crosslinked styrene acrylate polymer.

10. The toner according to claim 1, wherein the toner particles have an average particle size of from about 2 μm to about 10 μm, an average circularity of about 0.93 to about 0.98, a shape factor of from about 120 to about 140, and a volume geometric standard deviation for (D84/D50) in the range of from about 1.15 to about 1.25.

11. The toner according to claim 1, wherein the toner exhibits a gloss of at least about 30 GGU on plain paper.

12. A toner comprising emulsion aggregation toner particles comprising a core and a shell, wherein the core is comprised of a binder including a non-crosslinked styrene acrylate polymer, at least one colorant, at least one wax, and aluminized silica, and wherein the shell is comprised of a second non-crosslinked styrene acrylate polymer having a glass transition temperature higher than a glass transition temperature of the core non-crosslinked styrene acrylate polymer, wherein the core non-crosslinked styrene acrylate polymer has a glass transition temperature of about 45° C. to about 65° C., the second non-crosslinked styrene acrylate polymer of the shell has a glass transition temperature of about 50° C. to about 70° C., and wherein the glass transition temperature of the second non-crosslinked styrene acrylate polymer of the shell is at least about 4° C. higher than the glass transition temperature of the core non-crosslinked styrene acrylate polymer, wherein the toner is comprised of from about 70% to about 95% by weight of the core non-crosslinked styrene acrylate polymer and the second non-crosslinked styrene acrylate polymer, from about 5% to about 15% by weight of the wax, from about 2% to about 10% by weight of the colorant, and from about 0.5 to about 50 pph of the aluminized silica by weight of toner, and wherein an amount of aluminum metal in the toner particles is from about 50 ppm to about 600 ppm.

13. The toner according to claim 12, wherein the core non-crosslinked styrene acrylate polymer and the second non-crosslinked styrene acrylate polymer of the shell are derived from a same set of monomers.

14. The toner according to claim 13, wherein the core non-crosslinked styrene acrylate polymer and the second non-crosslinked styrene acrylate polymer are each derived from monomers including styrene, butyl acrylate and β-carboxyethyl acrylate.

15. The toner according to claim 12, wherein the toner particles have an average particle size of from about 2 μm to about 10 μm, an average circularity of about 0.93 to about 0.98, a shape factor of from about 120 to about 140, and a volume geometric standard deviation for (D84/D50) in the range of from about 1.15 to about 1.25.

16. The toner according to claim 12, wherein the toner exhibits a gloss of at least about 30 GGU on plain paper.

17. A method of making a toner comprising emulsion aggregation toner particles comprising a binder including a non-crosslinked styrene acrylate polymer, at least one colorant, at least one wax, and aluminized silica, wherein an amount of aluminum metal in the toner particles is from about 50 ppm to about 600 ppm, wherein the toner is comprised of from about 70% to about 95% by weight of the non-crosslinked styrene acrylate polymer, from about 5% to about 15% by weight of the wax, from about 2% to about 10% by weight of the colorant, and from about 0.5 to about 50 pph of the aluminized silica by weight of toner, the method comprising:

obtaining a latex of the non-crosslinked styrene acrylate polymer, an aqueous dispersion of the at least one colorant, an aqueous dispersion of the at least one wax, and an aqueous dispersion of the aluminized silica, forming a mixture of the latex of the non-crosslinked styrene acrylate polymer, the aqueous dispersion of the at least one colorant, and the aqueous dispersion of the at least one wax, adding some or all of the aqueous dispersion of the aluminized silica to the mixture, stirring the mixture, and heating the mixture to a temperature below a glass transition temperature of the non-crosslinked styrene acrylate polymer, any remaining portion of the aqueous dispersion of the aluminized silica being added to the mixture during the heating, maintaining the temperature of heating to form aggregated toner particles, adding a solution of a sequestering agent, followed by stopping further aggregation and raising the temperature to at least about 80° C. to coalesce the aggregated particles, and subsequently cooling, optionally washing, and recovering the emulsion aggregation toner particles, wherein the sequestering agent is added in an amount to extract aluminum ions from the solution such that the final aluminum content in the toner is from abut 50 ppm to about 600 ppm.

* * * * *